US005292275A

United States Patent [19]

Swisher et al.

[11] Patent Number: 5,292,275

[45] Date of Patent: Mar. 8, 1994

[54] TOY VEHICLE HAVING GROWLING ACTION

[75] Inventors: Gary R. Swisher, Hermosa Beach; Kevin W. Gray, San Pedro; Thomas M. Robinson, Lakewood, all of Calif.

[73] Assignee: Mattel, Inc., El Segundo, Calif.

[21] Appl. No.: 931,100

[22] Filed: Aug. 17, 1992

[51] Int. Cl.[5] ..... A63H 5/00; A63H 17/26; A63H 17/00

[52] U.S. Cl. ..... 446/409; 446/470; 446/471; 446/94

[58] Field of Search ..... 446/409, 410, 404, 397, 446/437, 465, 466, 470, 471, 487, 427, 428, 93, 94, 95, 313, 337, 304

[56] References Cited

U.S. PATENT DOCUMENTS

| | | | |
|---|---|---|---|
| 3,308,573 | 3/1967 | Ryan | 446/427 X |
| 4,248,006 | 2/1981 | Jones et al. . | |
| 4,249,339 | 2/1981 | Crain et al. | 446/397 X |
| 4,324,065 | 4/1982 | Cooper | 446/337 |
| 4,424,978 | 1/1984 | Kassai . | |
| 4,540,379 | 9/1985 | Tachibana | 446/437 X |
| 4,568,307 | 2/1986 | Gabler et al. | 446/466 X |
| 4,655,727 | 4/1987 | Swisher et al. . | |
| 4,681,554 | 7/1987 | Hsien-Yang | 446/487 X |
| 4,690,655 | 9/1987 | Bailey . | |
| 4,717,367 | 1/1988 | Stubenfoll et al. | 446/437 |
| 4,764,146 | 8/1988 | Auer et al. | 446/428 X |
| 4,778,433 | 10/1988 | McKay et al. | 446/304 |
| 4,805,328 | 2/1989 | Mirahem . | |
| 4,925,427 | 5/1990 | Wu . | |
| 4,964,837 | 10/1990 | Collier . | |
| 4,997,404 | 3/1991 | May . | |
| 5,024,626 | 6/1991 | Robbins et al. . | |
| 5,045,016 | 9/1991 | Stern et al. . | |
| 5,074,821 | 12/1991 | McKeefery et al. . | |
| 5,108,341 | 4/1992 | DeSmet . | |
| 5,112,267 | 5/1992 | Lin et al. | 446/470 |

FOREIGN PATENT DOCUMENTS

| | | | |
|---|---|---|---|
| 2625446 | 7/1989 | France | 446/409 |
| 2014461 | 8/1979 | United Kingdom | 446/428 |

*Primary Examiner*—David N. Muir
*Attorney, Agent, or Firm*—Roy A. Ekstrand

[57] ABSTRACT

A toy vehicle includes a supporting chassis having a plurality of rolling wheels secured thereto. The chassis supports an audio circuit, a battery and an audio transducer together with a pair of switch contacts configured to provide a growling sound when the switch contacts touch. The chassis further supports an articulated body having a cab portion and rear portion resembling a standard truck joined in a pivotal attachment. A shaft and cam mechanism is coupled to a movable arm in a cooperative arrangement in which pivotal motion of the movable arm closes the switch contacts activating the audio circuit and raising the cab and rear portion of the truck body to bear sets of hidden teeth at the front of the toy vehicle.

9 Claims, 3 Drawing Sheets

TOY VEHICLE HAVING GROWLING ACTION

CROSS REFERENCE TO RELATED APPLICATION

This application is related to a copending application filed Aug. 15, 1992 in the name of Keith Hippely, Gary Swisher and Terrance Choy and entitled TOY VEHICLE HAVING ARTICULATED JAWS which is hereby incorporated herein by reference.

FIELD OF THE INVENTION

This invention relates generally to toy vehicles and particularly to those having sound producing action.

BACKGROUND OF THE INVENTION

Miniature toy vehicles which replicate actual full-sized vehicles with some level of authenticity have been well known in the art for many years. Another type of toy vehicle emerging more recently provides a fanciful or exaggerated appearance rather than an accurate or closely accurate appearance. Within this type of fanciful toy vehicle have been found vehicles which assume animal-like appearance, robotic or futuristic appearances, as well as vehicles which are formed of a plurality of interconnected components which facilitate the configuration of the toy vehicle into two or more dramatically different appearances.

For example, U.S. Pat. No. 4,655,727 issued to Swisher et al sets forth a TOY VEHICLE in which a base portion, a top portion and a mechanical arrangement linking the base and top portions is provided. The mechanical linkage permits the top portion to move between several different positions with respect to the base portion thereby providing different appearance characteristics for the vehicle.

U.S. Pat. No. 4,568,307 issued to Gabler et al sets forth a PUSH TOY VEHICLE WITH OPERABLE MOUTH in which a toy vehicle includes a plurality of rolling wheels and an articulated jaw portion supported in a pivotal attachment to the forward portion of the vehicle. Operable means are provided which rotate in response to the rotational motion of the vehicle supporting wheels to provide operation of the pivotally mounted mouth or jaw portion. Thus, as the toy vehicle is rolled across a play surface, the mouth portion is operated.

U.S. Pat. No. 4,248,006 issued to Jones et al sets forth a RECONFIGURABLE MOVING ANIMAL SIMULATING TOY in which an upper body section and lower body section are operatively attachable in a plurality of configurations. A compressible bellows and a nozzle are operatively connected to a liquid container within the upper body section. The bellows may be depressed to expel liquid from the upper body portion.

U.S. Pat. No. 4,424,978 issued to Kassai sets forth a VEHICLE FOR CHILDREN in which a chassis and body are configured to receive a child in a sitting position straddling the toy vehicle. A simulated steering wheel and fanciful hood portion are secured to the toy vehicle. A latch release mechanism extends forwardly from the vehicle front bumper and provides release of the hood portion causing it to spring open upon impact with another object.

U.S. Pat. No. 5,045,016 issued to Stern et al sets forth a TOY VEHICLE WITH ELECTRONIC SOUNDER AND DIRECTION SENSOR in which a truck-like toy vehicle is configured to be manually pushed or rolled across a play surface. Sound producing means are supported within the truck together with a direction sensor. The sound producing means provide different sounds in response to the directional motion of the toy vehicle.

U.S. Pat. No. 4,964,837 issued to Collier sets forth a RADIO CONTROLLED MODEL VEHICLE HAVING COORDINATED SOUND EFFECTS SYSTEM in which a radio controlled toy vehicle supports conventional propulsion and control apparatus together with a radio controller receiver. In addition, sound producing means are provided within the vehicle to output predetermined sound effects in response to certain control input conditions.

U.S. Pat. No. 4,925,427 issued to Wu sets forth a CONVERTIBLE TOY CAR HAVING A TWO-LEVEL CAM in which a toy vehicle includes a two-level cam, sound assembly, projection assembly, signal light, and a signal light activation arm. The two-level cam includes an upper and a lower cam and is driven indirectly by a battery powered electric motor and series of gears. The upper cam drives the projection assembly to project toy figures out of the car doors while spring members cause the toy figures to return to their original positions.

U.S. Pat. No. 4,997,404 issued to May sets forth a TOY VEHICLE SOUND SYSTEM incorporating a sound effect generator similar to an acoustical phonograph and having a machined turntable with mutually exclusive sound tracks. Each of the sound tracks creates a different sound effect through a tone arm and speaker arrangement. The turntable is driven by a gear train operable in response to rotation of the vehicle wheels.

U.S. Pat. No. 5,024,626 issued to Robbins et al sets forth a SOUND PRODUCING REMOTE CONTROL TOY VEHICLE in which a remote control toy vehicle includes a motor for selectively driving the toy vehicle as well as a manually actuatable first control switch. The remote control also includes a sound producing circuit for selectively producing sounds related to the toy vehicle.

While the foregoing described prior art devices have provided some measure of amusement and enjoyment, there remains nonetheless a continuing need in the art for evermore interesting and amusing toy vehicles.

SUMMARY OF THE INVENTION

Accordingly, it is a general object of the present invention to provide an improved toy vehicle. It is a more particular object of the present invention to provide an improved toy vehicle having coordinated configuration changes and sound producing action.

In accordance with the present invention, there is provided a toy vehicle which comprises a chassis having a plurality of supporting wheels, sound producing means, a body having a cab portion, a rear portion, and a pivotal attachment therebetween, pivot means coupled to the rear portion and the chassis for pivoting the rear portion relative to the chassis and raising the cab portion, and switch means actuated by the pivot means for activating the sound producing means when the rear portion is pivoted, the cab portion undergoing pivotal motion with respect to the rear portion as it is raised due to the pivotal attachment.

BRIEF DESCRIPTION OF THE DRAWINGS

The features of the present invention, which are believed to be novel, are set forth with particularity in the appended claims.

The invention, together with further objects and advantages thereof, may best be understood by reference to the following description taken in conjunction with the accompanying drawings, in the several figures of which like reference numerals identify like elements and in which.

DESCRIPTION OF THE PREFERRED EMBODIMENTS

Figure 1:
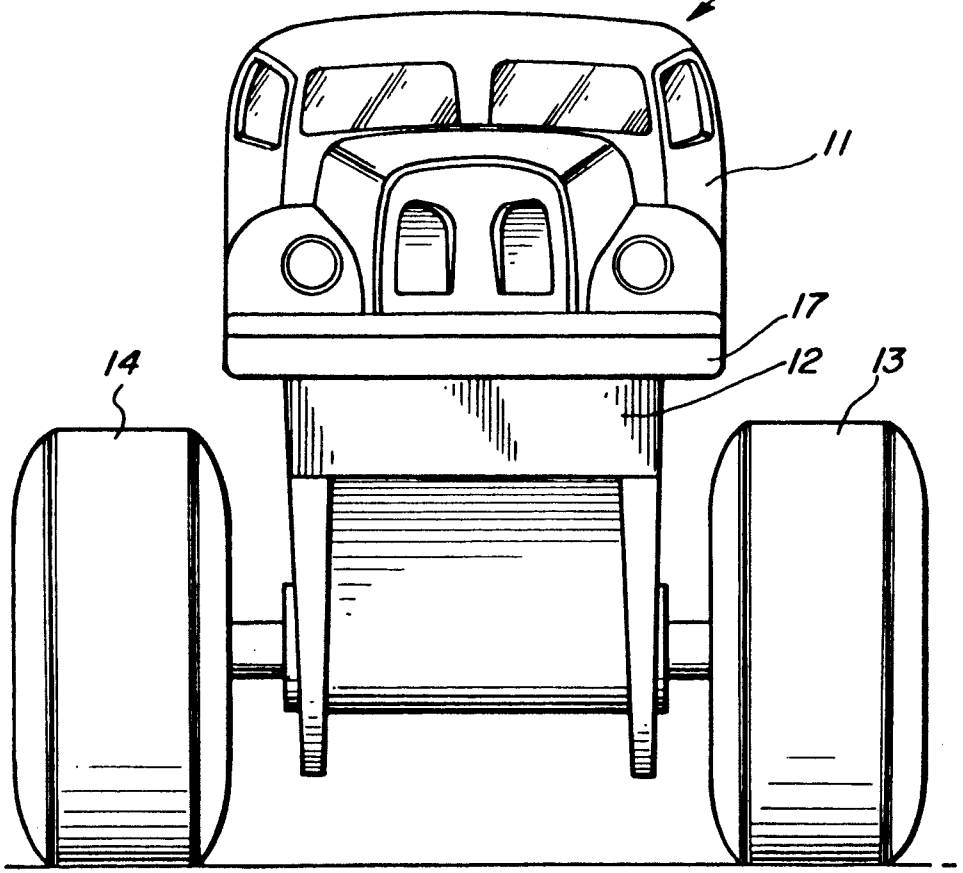
FIG. 1 sets forth a front view of a toy vehicle constructed in accordance with the present invention in the closed position.

FIG. 1 sets forth a front view of a toy vehicle constructed in accordance with the present invention and generally referenced by numeral 10. Toy vehicle 10 includes a body 11 supported upon a chassis 12 and having a front bumper 17. Chassis 12 supports a pair of front wheels 13 and 14 and a pair of rear wheels 15 and 16 (seen in FIG. 3) in accordance with conventional fabrication techniques. In the position in FIG. 1, body 11 is configured in its closed position and gives the appearance of a more or less conventional four-wheel drive truck vehicle or the like.

Figure 2:
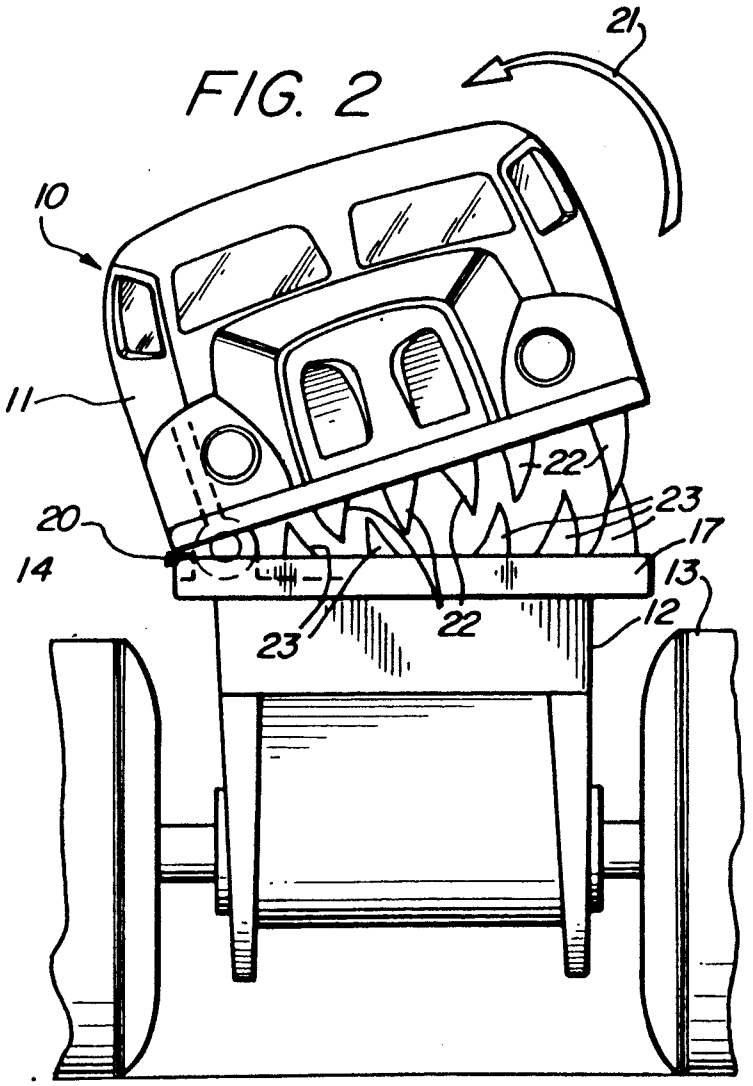
FIG. 2 sets forth a front view of the present invention toy vehicle in a partially opened position.

FIG. 2 sets forth a front view of toy vehicle 10 as the growling action described below in greater detail is initiated. By means set forth below in greater detail, body 11 is pivotally secured to chassis 12 by a hinge mechanism 20 located on the passenger side of vehicle 10. As mentioned, chassis 12 supports body 11 and in accordance with conventional fabrication techniques, also supports a plurality of rolling wheels 13, 14, 15 and 16 (the latter two shown in FIG. 3). By means set forth below in greater detail, as body 11 is pivoted about hinge 20 in the direction indicated by arrow 21, a plurality of upper teeth 22 and lower teeth 23 previously concealed by body 11 and chassis 12 in the closed position are now exposed giving rise to a snarling or growling type action on the part of toy vehicle 10. By means also set forth below in greater detail, the pivotal motion of body 11 to the growling configuration shown is further accompanied by the activation of a sound producing unit within toy vehicle 10 to cause snarling or growling sounds to emanate from toy vehicle 10 as body 11 pivots and teeth 22 and 23 are exposed. Once the growling action and snarling configuration of toy vehicle 10 is terminated, body 11 returns to the conventional closed position shown in FIG. 1.

Figure 3:
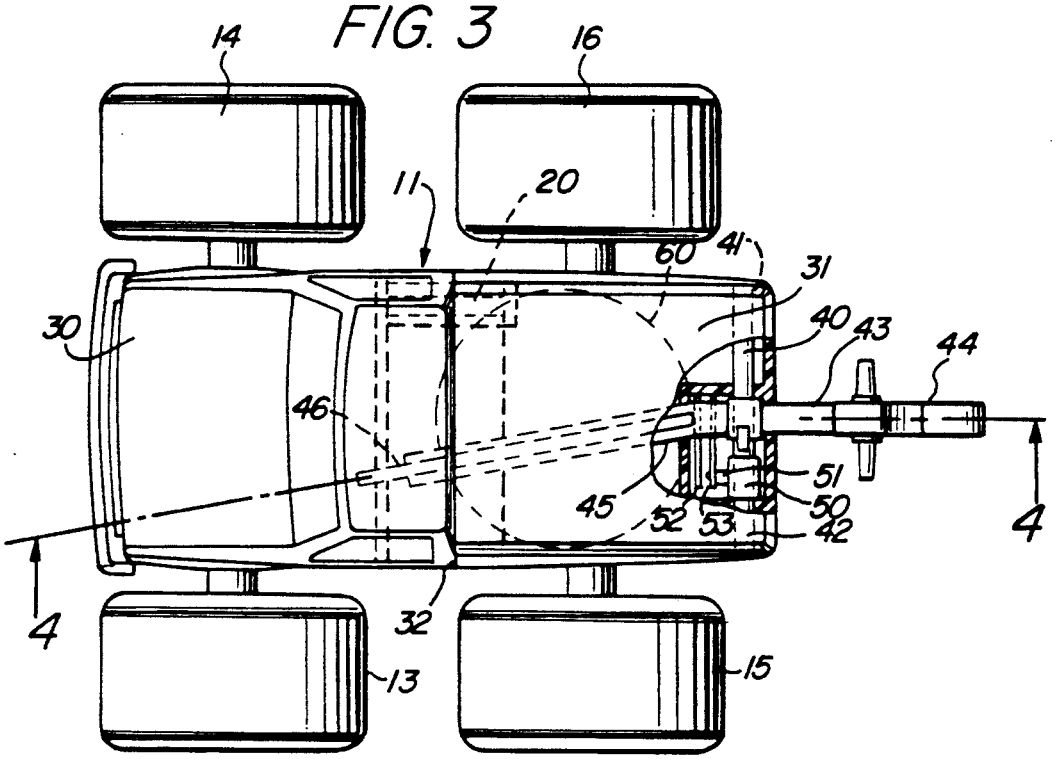
FIG. 3 sets forth a partially sectioned top view of the present invention toy vehicle.

FIG. 3 sets forth a partially sectioned top view of the present invention toy vehicle shown in FIGS. 1 and 2. As described therein, toy vehicle 10 includes a body generally referenced by numeral 11. Body 11 comprises a front cab portion 30 and a rear portion 31. Rear portion 31 and cab portion 30 meet at a seam 32, As described above, chassis 12 supports wheels 13–16 in accordance with conventional fabrication techniques and permits toy vehicle 10 to be rolled across a play surface in a more or less conventional manner. Chassis 12 supports a front bumper 17 and a hinge mechanism 20. The structure of hinge mechanism 20 is set forth below in greater detail. However, suffice it to know here that hinge mechanism 20 provides a pivotal coupling between cab portion 30 and rear portion 31 of body 11. It should be noted that hinge 20 is offset from the center portion of body 11.

In accordance with the present invention, a generally cylindrical shaft 40 extends transversely across the back of rear portion 31 of body 11. Shaft 40 is securely attached to rear portion 31 by a pair of shaft attachments 41 and 42 on each end thereof. An elongated arm 43 is secured to shaft 40 such that pivotal motion of arm 43 causes a corresponding location of shaft 40. Arm 43 terminates at its outer end in a hook portion 44. A second arm 45 is secured to arm 43 and shaft 40 and thus is pivoted in response to pivotal motion of arm 43 and hook 44. While arm 43 is in general alignment with the front-to-back axis of body 11, arm 45 is angularly disposed and tends to point towards the front driver's side corner of cab portion 30. Arm 45 terminates in an open-faced fork 46 which receives a pin 47 (seen in FIG. 4) providing coupling between fork 46 and cab portion 30 of body 11.

In accordance with an important aspect of the present invention, a generally cylindrical switch collar 50 is secured to shaft 40 and includes a forwardly extending switch cam 51. Collar 50 and switch cam 51 are secured to shaft 40 such that rotational motion of shaft 40 causes a corresponding rotational motion of switch cam 51. A pair of spaced apart switch contacts 52 and 53 are supported in front of switch collar 50. Switch contact 53 is positioned within the travel path of switch cam 51 as shaft 40 is rotated. It is important to note that the coupling between fork 46 and pin 47 between arm 45 and cab portion 30 is offset on the opposite side of hinge mechanism 20. Thus, lifting forces exerted against cab portion 30 by arm 45 described below tend to lift the driver's side of cab portion 30 causing cab portion 30 to pivot about hinge 20 in the manner set forth above in FIG. 2.

Figure 4:
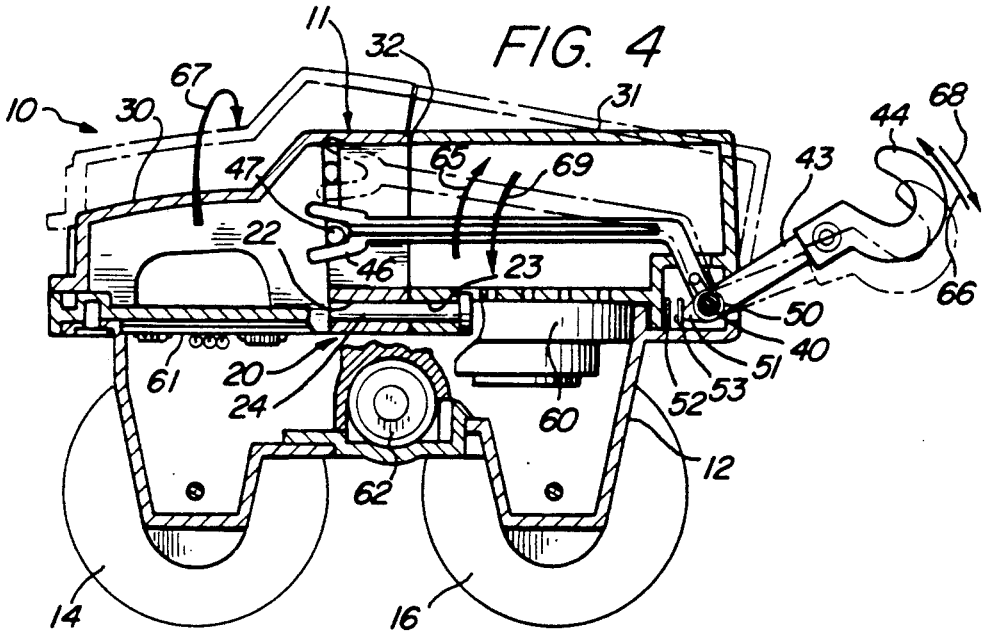
FIG. 4 sets forth a section view of the present invention toy vehicle taken along section lines 4—4 in FIG. 3.

FIG. 4 sets forth a section view of toy vehicle 10 taken along section lines 4—4 in FIG. 1. As described above, toy vehicle 10 includes a chassis 12 having a plurality of supporting wheels including wheels 14 and 16. Chassis 12 further supports a conventional battery power source 62. An audio circuit 61 is supported on the underside of chassis 12 and includes conventional circuitry for producing simulated growling sounds when energized. An audio transducer 60, which may comprise a piezoelectric transducer or small speaker or its equivalent, is supported on the underside of the top portion of chassis 12 in accordance with conventional fabrication techniques. A plurality of coupling wires (not shown) provide interconnections between battery 62, audio circuit 61, audio transducer 60 and switch contacts 52 and 53. Contacts 52 and 53 comprise an on/off switch for audio circuit 61 such that so long as contacts 52 and 53 are spaced apart in the position shown in FIG. 4, the coupling of battery 62 to audio circuit 61 is interrupted and vehicle 10 is unable to produce sounds.

Cab portion 30 of body 11 defines a cylindrical bore 22 which receives a portion of hinge pin 24. In addition, rear portion 31 of body also defines a cylindrical bore 23 generally in alignment with bore 22 of cab portion 30. Hinge pin 24 extends through bore 23 of rear portion 31 and is received within bore 22 of cab portion 30. The combination of bores 22 and 23 and hinge pin 24 provides the above-described hinge mechanism generally referenced by numeral 20.

As described above, shaft 40 extends transversely within rear portion 31 and is securely attached to rear portion 31 of body 11 by attachments 41 and 42. Attachments 41 and 42 are fabricated in accordance with conventional fabrication techniques and may, for example, comprise a molded junction or adhesive attachment or its equivalent. The important aspect of the attachment between shaft 40 and rear portion 31 of body 11 is the pivotal motion which results in rear portion 31 as shaft 40 is rotated. Arm 43 is secured to shaft 40 and terminates in an upwardly facing hook 44. A second arm 45 is similarly secured to shaft 40 and arm 43 and terminates in a forwardly facing fork 46. Fork 46 receives pin 47 of cab portion 30 to provide a direct coupling between arm 45 and cab portion 30.

Switch cam 51 extends forwardly from sleeve collar 50 which in turn is secured to shaft 40. Thus, in operation with toy vehicle 10 initially in the closed position shown in FIG. 4, switch contacts 52 and 53 remain separated and cab portion 30 and rear portion 31 of body 11 rest upon the upper surface of chassis 12. In addition, the separation of switch contacts 52 and 53 renders audio circuit inactive and as a result, no sound output is produced by audio transducer 60. Arm 43 and hook 44 occupy the raised angular position shown in FIG. 4.

As hook 44 and arm 43 are pivoted downwardly in the direction indicated by arrow 66, shaft is correspondingly rotated raising rear portion 31 which in turn raises cab portion 30 to the dashed line position shown in FIG. 4. In addition, as shaft 40 rotates, switch collar 50 and switch cam 51 rotate in a clockwise direction about shaft 40 bringing switch cam 51 against switch contact 53 forcing contact 53 into contact with contact 52 thereby completing the battery power circuit for audio circuit 61. Thus, audio circuit 61 is activated and produces audio output signals which are converted by audio transducer 60 into growling sounds. Concurrently, as shaft 40 rotates in a clockwise direction due to the pivotal motion of arm 43 and hook 44 downwardly in the direction of arrow 66, arm 45 is pivoted about shaft 40 in the direction indicated by arrow 65. The coupling between fork 46 and pin 47 causes cab portion 30 to be rotated about hinge pin 24 in the direction indicated by arrow 67. Because switch cam 51 continues to provide closure between switch contacts 52 and 53, audio circuit 61 and audio transducer 60 continue to produce growling sounds until arm 43 and hook 44 are pivoted upwardly in the direction indicated by arrow 68 which in turn lowers rear portion 31 toward chassis 12 and pivots arm 45 in the direction indicated by arrow 69 thereby returning cab portion 30 to its normal alignment with rear portion 31. As shaft 40 is rotated in a counterclockwise direction, switch collar 50 and switch cam 51 rotate correspondingly which removes switch cam 51 from contact with switch contact 53 and permits the connection between contacts 53 and 52 to be interrupted. This in turn terminates the production of growling sounds by audio circuit 61.

It will be apparent to those skilled in the art that variety of conventional audio circuits may be utilized for audio circuit 61 and thus the details of audio circuit 61 need not be described herein. Suffice it to note here that sound producing circuits are well known in the art and any one of a large number of conventional audio circuits may be used for circuit 61 without departing from the spirit and scope of the present invention.

Figure 5:
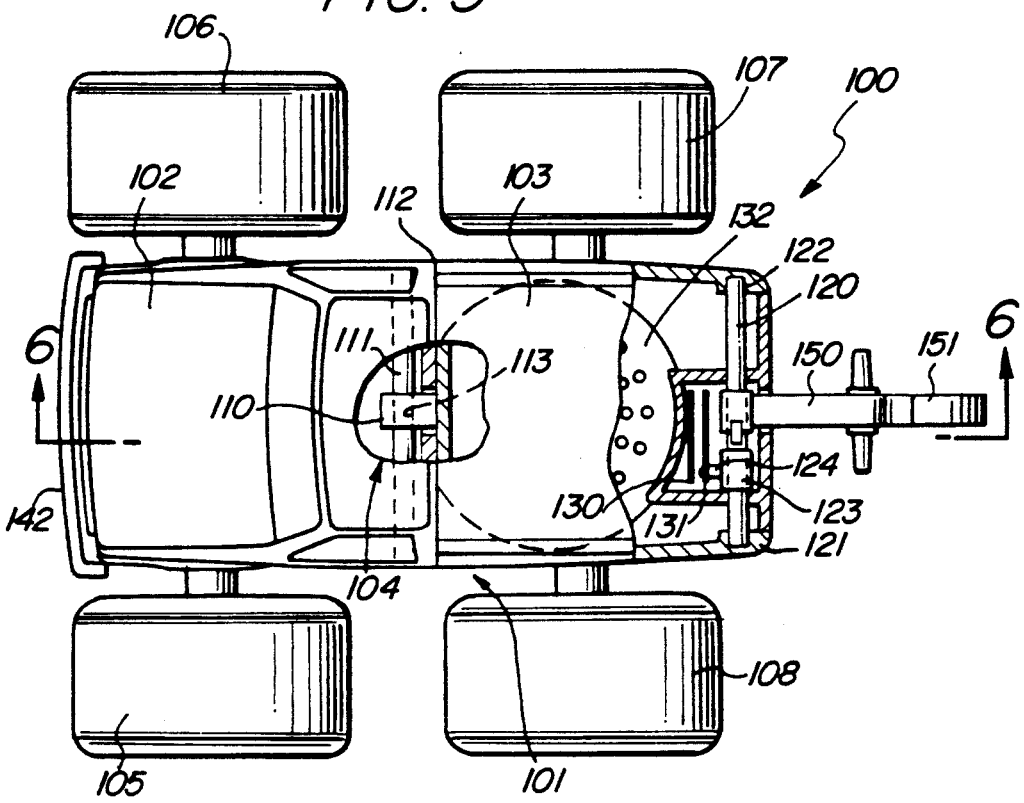
FIG. 5 sets forth a partially sectioned top view of an alternate embodiment of the present invention toy vehicle.
Figure 6:
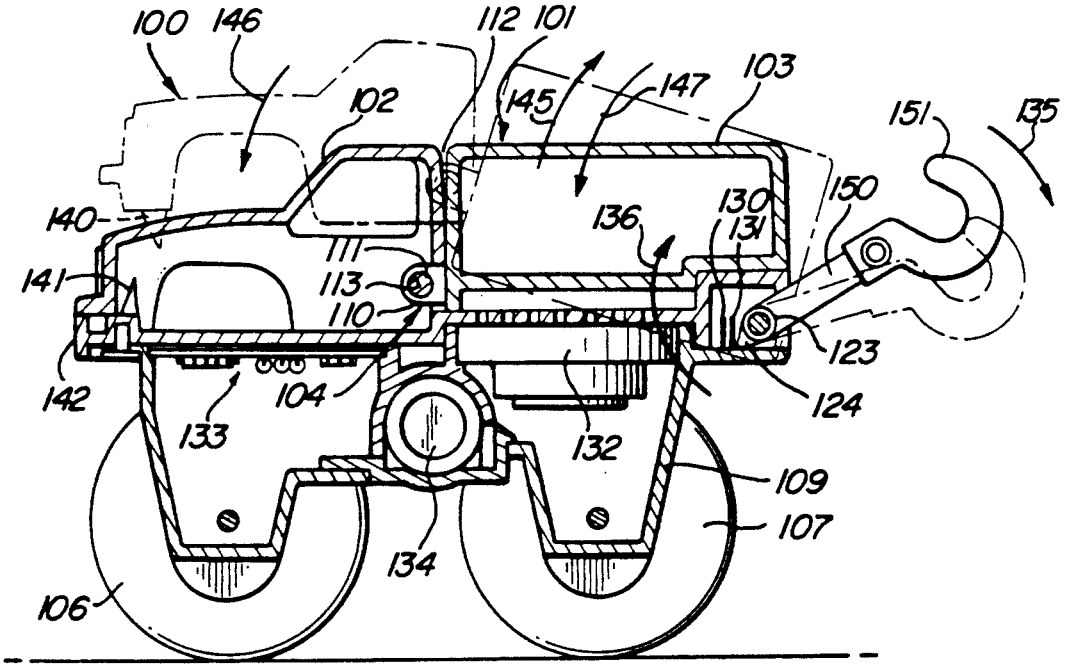
FIG. 6 sets forth a section view of the alternate embodiment of FIG. 5 taken along section lines 6—6 in FIG. 5.

FIGS. 5 and 6 set forth an alternate embodiment of the present invention in which FIG. 5 shows a partially sectioned top view of this alternate embodiment while FIG. 6 sets forth a section view thereof taken along section lines 6—6 in FIG. 5.

More specifically, FIG. 5 sets forth an alternate embodiment of the present invention generally referenced by numeral 100. Toy vehicle 100 includes a body 101 having a front cab portion 102 and a rear portion 103. Cab portion 102 and rear portion 103 meet at a seam 112 and are joined in a pivotal attachment by hinge coupling 104. Hinge coupling 104 comprises a forwardly extending tab 110 joined to rear portion 103 and a transversely extending pivot 111 secured to cab portion 102 and passing through aperture 113 in tab 110. Toy vehicle 100 further includes a support chassis 109 (seen in FIG. 6) having a plurality of rolling wheels 105–108 secured thereto in accordance with conventional fabrication techniques. Chassis 109 further includes a front bumper 142 positioned ahead cab portion 102. An elongated transverse shaft 120 is secured to rear portion 103 of body 101 by conventional attachments 121 and 122. An arm 150 is secured to shaft 120 and terminates in a hook 151. A switch collar 123 is secured to shaft 120 and defines a forwardly and downwardly extending switch cam 124. A pair of switch contacts 130 and 131 are secured in a spaced apart arrangement ahead of switch cam 124. An audio transducer 132 and an audio circuit 133 (the latter seen in FIG. 6) are secured to chassis 109.

FIG. 6 sets forth a section view of toy vehicle 100 taken along section lines 6—6 in FIG. 5. As described therein, toy vehicle 100 includes a body 101 having a cab portion 102 and a rear portion 103 joined at hinge coupling 104. Rear portion 103 includes a forwardly extending tab 110 having an aperture 113 defined therein. A pin 110 is received within aperture 113 and is secured to cab portion 102. Cab portion 102 further defines a plurality of downwardly extending teeth 140. Correspondingly, chassis 109 defines a cooperating plurality of teeth 141 extending upwardly behind bumper 142. An elongated shaft 120 extends transversely through body 101 and is secured thereto by a pair of attachments 121 and 122 (seen in FIG. 5). An arm 150 is secured to shaft 120 and terminates in an upwardly facing hook 151. Shaft 120 further supports an attached collar 123 having a forwardly and downwardly extending switch cam 124. A pair of switch contacts 130 and 131 are positioned ahead of shaft 120 in a spaced apart arrangement in which contact 131 lies within the travel path of switch cam 124. Audio circuit 133, battery 134 and audio transducer 132 supported by chassis 109 are operatively coupled to switch contacts 130 and 131 by conventional electric wiring means (not shown) such that audio circuit 133 is inoperative so long as switch contacts 130 and 131 remain separated. If, however, switch contacts 131 and 132 are brought into contact, audio circuit 133 is energized producing electrical signals which cause audio transducer 132 to out-produce simulated growling and snarling sounds. As mentioned above, audio circuit 133 may be constructed in accordance with a variety of conventional circuit fabrication techniques without departing from the spirit and scope of the present invention.

In operation, with toy vehicle 100 initially positioned in the closed position shown in FIG. 6, rear portion 103 and cab portion 102 of body 101 rests upon chassis 109 in a straight line conventional alignment. Correspondingly, switch contacts 130 and 131 remain separated and thus audio circuit 133 is inoperative and growling sounds are not produced by toy vehicle 100. The growling action of toy vehicle 100 is initiated by the user exerting a force upon hook 151 pivoting hook 151 and arm 150 downwardly in the direction indicated by arrow 135. The pivotal motion of arm 150 causes a corresponding rotation of shaft 120 which, due to attachments 121 and 122, begins the pivotal motion of rear portion 103 of body 101 in the direction indicated by arrow 145. As rear portion 103 is raised, the pivotal attachment provided by hinge coupling 104 through tab 110 and pin 111 raises cab portion 102 while causing it to pivot downwardly in the direction indicated by arrow 146. As arm 150 and hook 151 continue to be pivoted downwardly in the direction indicated by arrow 135, rear portion 103 and cab 102 of body 101 are raised to the dashed line position shown in FIG. 6. As a result, teeth 140 of cab 102 and teeth 141 of chassis 109 are exposed above bumper 142 providing a bared teeth animal-like character for toy vehicle 100. Concurrently, as shaft 120 continues to rotate in the direction indicated by arrow 136, switch cam 124 is correspondingly pivoted forcing contact 131 against contact 130 and causing audio circuit 133 to be energized. With the energizing of audio circuit 133, audio transducer 132 produces audible growling sounds. Upon the release of hook 151 and arm 150, the gravitational force upon rear portion 103 and cab 102 pivots body 101 in the direction indicated by arrow 147 until rear portion 103 and cab potion 102 again rests upon chassis 109 in the manner shown in FIG. 6. Correspondingly, the pivotal motion of rear portion 103 downwardly in the direction of arrow 147 causes shaft 120 to be pivoted in a counterclockwise direction raising arm 150 and hook 151 while pivoting switch cam 124 away from contact 131. As cam 124 is pivoted away from switch contact 131, the connection between 130 and 131 is opened and the operation of audio circuit 133 ceases terminating the output of growling sounds.

What has been shown is an entertaining and amusing toy vehicle which in response to manipulation of a single hook and lever causes the production of growling sounds together with a movement of the truck body and cab which bears two sets of hidden teeth on the front portion of the vehicle and causes a pivotal motion between the cab and rear portion of the body to add additional interest and activity giving the vehicle a "snarling" character.

While particular embodiments of the invention have been shown and described it will be obvious to those skilled in the art that changes and modifications may be made without departing from the invention in its broader aspects. Therefore the aim in the appended claims is to cover all such changes and modifications as fall within the true spirit and scope of the invention.

What is claimed is:

1. A toy vehicle comprising:

a chassis having a plurality of supporting wheels;

sound producing means supported upon said chassis for producing predetermined sounds;

a body having a cab portion, a rear portion pivotally coupled to said chassis, and a pivotal attachment between said cab and rear portions;

pivot means coupled to said rear portion and said chassis for pivoting said rear portion relative to said chassis and raising said cab portion causing pivotal motion between said rear portion and said cab portion; and switch means coupled to said sound producing means and said pivot means and actuated by said pivot means activating said sound producing means when said rear portion is pivoted away from said chassis;

said cab portion undergoing pivotal motion with respect to said rear portion as it is raised due to said pivotal attachment.

2. A toy vehicle as set forth in claim 1 wherein said pivot means includes:

a rear arm extending from said rear portion;

a shaft coupled to said rear portion and to said arm rotatable therewith;

a switch having an actuator; and a cam disposed upon said shaft operating said actuator as said shaft is rotated in a first direction in which said rear portion is raised.

3. A toy vehicle as set forth in claim 2 wherein said cab portion defines a first plurality of downwardly extending simulated teeth and wherein said chassis includes means for hiding said first plurality of simulated teeth when said cab portion is not raised.

4. A toy vehicle as set forth in claim 3 wherein said chassis includes a second plurality of simulated teeth extending upwardly into said cab portion and visible solely when said cab portion is raised.

5. A toy vehicle as set forth in claim 4 wherein said pivotal attachment includes a hinge generally centered with respect to said cab portion and said rear portion.

6. A toy vehicle as set forth in claim 5 wherein said cab portion and said rear portion define a front to back axis of symmetry and wherein said hinge includes a tab extending forwardly from said rear portion along said axis of symmetry having an aperture therein and a pin coupled to said cab portion and passing through said aperture.

7. A toy vehicle as set forth in claim 4 wherein said pivotal attachment includes a hinge positioned proximate one side of said cab portion and said rear portion whereby said cab portion pivots with respect to said rear portion about an offset front-to-back axis.

8. A toy vehicle as set forth in claim 7 wherein said hinge includes a pair of axially aligned front-to-back bores defined in said cab portion and said rear portion and a hinge pin received within said bores.

9. A toy vehicle as set forth in claim 8 wherein said pivot means includes:

a forward arm coupled to said shaft pivotable therewith and having a coupling opening at the forward end thereof; and a coupling member attached to said cab portion and cooperating with said opening;

said coupling member being offset to the opposite side of said cab portion from that of said hinge.

* * * * *